US009144774B2

(12) United States Patent
Livshits et al.

(10) Patent No.: US 9,144,774 B2
(45) Date of Patent: Sep. 29, 2015

(54) FLUID MIXER WITH INTERNAL VORTEX

(75) Inventors: David Livshits, San Francisco, CA (US); Lester Teichner, Chicago, IL (US)

(73) Assignee: Turbulent Energy, LLC, Lexington, MA (US)

( * ) Notice: Subject to any disclaimer, the term of this patent is extended or adjusted under 35 U.S.C. 154(b) by 1410 days.

(21) Appl. No.: 12/886,318

(22) Filed: Sep. 20, 2010

(65) Prior Publication Data

US 2011/0069579 A1 Mar. 24, 2011

Related U.S. Application Data

(60) Provisional application No. 61/244,617, filed on Sep. 22, 2009.

(51) Int. Cl.
*B01F 5/04* (2006.01)
*B01F 3/04* (2006.01)
(Continued)

(52) U.S. Cl.
CPC ..... *B01F 3/04446* (2013.01); *B01F 3/0446* (2013.01); *B01F 5/0206* (2013.01); *B01F 2005/0017* (2013.01)

(58) Field of Classification Search
CPC ..... B01F 3/00; B01F 5/00; B01F 2001/00; B01F 3/04446; B01F 5/0206; B01F 3/0446; B01F 2005/0017
USPC ..... 366/101, 151.1, 174.1, 165.1, 165.2
See application file for complete search history.

(56) References Cited

U.S. PATENT DOCUMENTS 2,295,740 A 9/1942 Keen
2,916,878 A * 12/1959 Wirt ..... 60/759
(Continued)

FOREIGN PATENT DOCUMENTS

DE 3723618 12/1988
DE 4211031 10/1993
(Continued)

OTHER PUBLICATIONS

International Search Report for International Application No. PCT/US2008/75366, Nov. 13, 2008, 2 pp.
(Continued)

*Primary Examiner* — Nahida Sultana
(74) *Attorney, Agent, or Firm* — Vedder Price, P.C.

(57) ABSTRACT

The present disclosure generally relates to a fluid mixer, a system for mixing fluids utilizing the fluid mixer, and a method of mixing fluids using the fluid mixer or the system for mixing fluids, and more specifically, to a compact static mixing device with no moving parts and capable of mixing any fluid, such as air, nitrogen gas, water, oil, polluted water, and the like. A first pressurized, incoming fluid is accelerated locally by a section reduction, is split into streams, and then is released into a second fluid found in a closed volume or an open volume after a period of stabilization. The directed and controlled first fluid slides along an insert up to directional and angled fins at a vortex creator where suction forces from a self-initiating vortex in an internal cavity draws in at least part of the first fluid to fuel the vortex. The compactness and simplicity of the fluid mixer with internal vortex can be used alone within a closed volume in a conduit, in a sprayer, or within a fixed geometry to direct the mixing vortex to specific dimensions. One or more fluid mixers can also be used in an open volume such as a reservoir, a tank, a pool, or any other fluid body to conduct mixing. The technology alone, as part of a multimixer system, or as a method of mixing using the fluid mixer with internal vortex is contemplated to be used in any field where mixing occurs.

9 Claims, 7 Drawing Sheets

(51) Int. Cl.

| | |
|---|---|
| ***B08B 3/04*** | (2006.01) |
| ***B01F 15/02*** | (2006.01) |
| ***B01F 5/02*** | (2006.01) |
| *B01F 5/00* | (2006.01) |

(56) References Cited

U.S. PATENT DOCUMENTS

| | | | | |
|---|---|---|---|---|
| 3,735,778 | A | 5/1973 | Garnier | |
| 3,980,233 | A | 9/1976 | Simmons et al. | |
| 4,215,081 | A | 7/1980 | Brooks | |
| 4,218,012 | A | 8/1980 | Hamza et al. | |
| 4,315,405 | A * | 2/1982 | Pidcock et al. | 60/752 |
| 4,398,827 | A | 8/1983 | Dietrich | |
| 4,399,107 | A | 8/1983 | Bose | |
| 4,415,275 | A | 11/1983 | Dietrich | |
| 4,464,314 | A | 8/1984 | Surovikin et al. | |
| 4,553,504 | A | 11/1985 | Duggal et al. | |
| 4,812,049 | A | 3/1989 | McCall | |
| 4,917,152 | A | 4/1990 | Decker | |
| 4,954,147 | A | 9/1990 | Galgon | |
| 5,031,399 | A * | 7/1991 | Batakis et al. | 60/799 |
| 5,174,247 | A | 12/1992 | Tosa et al. | |
| 5,176,448 | A | 1/1993 | King et al. | |
| 5,183,335 | A | 2/1993 | Lang et al. | |
| 5,193,341 | A | 3/1993 | Sibbertsen et al. | |
| 5,330,105 | A | 7/1994 | Kaylor | |
| 5,372,281 | A | 12/1994 | Palmer et al. | |
| 5,449,114 | A | 9/1995 | Wells et al. | |
| 5,452,955 | A | 9/1995 | Lundstrom | |
| 5,460,449 | A | 10/1995 | Kent et al. | |
| 5,492,404 | A | 2/1996 | Smith | |
| 5,492,409 | A | 2/1996 | Karlsson et al. | |
| 5,575,561 | A | 11/1996 | Rohwer | |
| 5,657,631 | A | 8/1997 | Androsov | |
| 5,678,766 | A | 10/1997 | Peck et al. | |
| 5,820,256 | A | 10/1998 | Morrison | |
| 5,865,158 | A | 2/1999 | Cleveland et al. | |
| 5,918,465 | A * | 7/1999 | Schmid | 60/722 |
| 5,992,529 | A | 11/1999 | Williams | |
| 6,022,135 | A | 2/2000 | Williams | |
| 6,024,480 | A * | 2/2000 | Seaton et al. | 366/130 |
| 6,027,241 | A | 2/2000 | King | |
| 6,036,356 | A | 3/2000 | Yang et al. | |
| RE36,969 | E | 11/2000 | Streiff et al. | |
| 6,170,978 | B1 | 1/2001 | Short | |
| 6,367,262 | B1 | 4/2002 | Mongia et al. | |
| 6,422,735 | B1 | 7/2002 | Lang | |
| 6,432,148 | B1 | 8/2002 | Ganan-Calvo | |
| 6,534,023 | B1 | 3/2003 | Liou | |
| 6,626,381 | B2 * | 9/2003 | Parrish | 239/533.7 |
| 6,669,843 | B2 | 12/2003 | Arnaud | |
| 6,974,542 | B2 | 12/2005 | von Phul | |
| 6,986,832 | B2 | 1/2006 | Lamminen et al. | |
| 7,018,435 | B1 | 3/2006 | Wentinck | |
| 7,041,144 | B2 | 5/2006 | Kozyuk | |
| 7,080,516 | B2 * | 7/2006 | Pidcock et al. | 60/751 |
| 7,165,881 | B2 | 1/2007 | Holl | |
| 7,448,794 | B2 | 11/2008 | Hansen | |
| 8,715,378 | B2 * | 5/2014 | Livshits et al. | 44/629 |
| 2004/0099616 | A1 * | 5/2004 | Arnaud | 210/788 |
| 2004/0140273 | A1 * | 7/2004 | Arnaud | 210/788 |
| 2006/0150643 | A1 | 7/2006 | Sullivan | |
| 2007/0137590 | A1 | 6/2007 | Vetrovec | |
| 2007/0206435 | A1 | 9/2007 | Lester et al. | |
| 2008/0016968 | A1 | 1/2008 | McCall et al. | |
| 2008/0115774 | A1 * | 5/2008 | Conner | 123/592 |
| 2008/0194868 | A1 | 8/2008 | Kozyuk | |
| 2009/0178412 | A1 * | 7/2009 | Spytek | 60/752 |
| 2013/0266439 | A1 * | 10/2013 | Rubak et al. | 415/208.1 |
| 2013/0307168 | A1 * | 11/2013 | Brown | 261/128 |
| 2014/0069650 | A1 * | 3/2014 | Stegemoeller et al. | 166/305.1 |

FOREIGN PATENT DOCUMENTS

| | | |
|---|---|---|
| DE | 29612769 | 12/1996 |
| DE | 10310442 | 9/2004 |
| EP | 0044498 | 1/1982 |
| GB | 0853502 | 11/1959 |
| GB | 2263649 | 8/1993 |
| GB | 2334901 | 9/1999 |
| JP | 56130213 | 10/1981 |
| JP | 62079835 | 4/1987 |
| JP | 5161899 | 6/1993 |
| JP | 8131800 | 5/1996 |
| JP | 2001000849 | 1/2001 |
| JP | 2006326498 | 12/2006 |
| KR | 20040040926 | 5/2004 |
| RU | 2133829 | 7/1999 |
| SU | 1662653 | 7/1991 |
| WO | WO88/06493 | 9/1988 |
| WO | WO93/07960 | 4/1993 |
| WO | WO00/12202 | 3/2000 |
| WO | WO2006/038810 | 4/2006 |
| WO | WO2006/117435 | 11/2006 |
| WO | WO2007/086897 | 8/2007 |
| WO | WO2007/115810 | 10/2007 |
| WO | WO2009/021148 | 2/2009 |
| WO | WO2009/035334 | 3/2009 |

OTHER PUBLICATIONS

Written Opinion for International Application No. PCT/US2008/75366, Nov. 13, 2008, 5 pp.

International Search Report for International Application No. PCT/US2008/75374, Mar. 23, 2008, 4 pp.

Written Opinion for International Application No. PCT/US2008/75374, Mar. 23, 2008, 8 pp.

International Search Report for International Application No. PCT/US2008/75378, Nov. 18, 2008, 2 pp.

Written Opinion for International Application No. PCT/US2008/75378, Nov. 18, 2008, 5 pp.

International Search Report for International Application No. PCT/US2009/43547, Jul. 9, 2009, 2 pp.

Written Opinion for International Application No. PCT/US2009/43547, Jul. 9, 2009, 9 pp.

* cited by examiner

FLUID MIXER WITH INTERNAL VORTEX

CROSS REFERENCE TO RELATED APPLICATION

The present patent application claims priority from and the benefit of U.S. Provisional Patent Application No. 61/244,617, filed Sep. 22, 2009, entitled Fluid Mixer With Internal Vortex, which prior application is hereby incorporated herein by reference.

FIELD OF THE DISCLOSURE

The present disclosure relates generally to a fluid mixer, a system for mixing fluids utilizing the fluid mixer, and a method of mixing fluids using the fluid mixer or the system for mixing fluids, and more specifically, to a liquid or gas fluid mixer where a first fluid is compressed, accelerated, and split into a layer above the surface of a vortex generator with angled fins and an internal cavity of a self-initiating and -maintaining mixing vortex in a second fluid.

BACKGROUND

Simple things are often the hardest to master. Oil and vinegar are two liquids with divergent properties that do not mix under most conditions. Fish use air dissolved in water to breathe but tiny air bubbles are difficult to mix in large quantities in water. One way to mix fluids is to create dynamic mixing systems that require external energy, such as the use of a pump or a propeller to force fluids to mix. In many instances the use of a dynamic mixing system needing external energy is not the optimal solution for a mixing process. In most cases, use of external energy results in heating the fluids, deterioration of the mixing device, maintaining the external system, etc. Many industrial applications benefit from static mixing, which is mixing that uses only static or kinetic energy from the fluids themselves.

Many material processes and technologies require mixing. Air and fuel are mixed in the pistons of an automotive engine, fertilizer and water are mixed during the irrigation of land, medication is mixed with serum in hospitals, turbulent air bubbles are mixed with polluted water in water purification systems, hot water is mixed with cold water in cooking devices, fuel and oxidants are mixed in rocket reactors, recycled air and fresh, incoming air is mixed in aeration systems, chemicals are mixed in tanks during chemical processes, nitrogen gas is mixed into fertilizer to improve the output of plant food, water is given new properties via gasification to prevent seeping into soil by oxygenation of water, oil is separated from water via turbulent mixing processes, foam is created via high-intensity gasification of a fluid, emulsion results from unique conditions of mixing, and washing is based on dispersion of a liquid in air, to name only a few. The current technology relates to mixing technology in general and applies more specifically to any process or system where mixing of fluids is found.

Mixing processes, like other processes within systems, are now being scrutinized and redesigned to enable energy and cost savings. Improved static or dynamic mixing helps reduce the energy consumption of a device or process using the improved mixing. A static device that relies on the pressure level of pressurized incoming fluid, when made more efficient, results in less pressure to operate or creates a mixed fluid with a greater output pressure. The same improved static mixer may create less friction and may limit molecular disruption within the fluid. What is needed is a simple, energy- and cost-efficient, compact static mixer capable of improved mixing of fluids.

Energy is consumed when a static mixer includes revolving or moving parts. Energy is also consumed when a static mixer shuffles and directs fluids away from their primary flows into baffles or other deviations. What is needed is a static mixer with no moving parts capable of enhanced mixing without requiring major alterations to the flows of liquids.

Mixing of fluids and mixing in the industrial and chemical industries, because of the nature and properties of these fluids, may be directed to a simply controlled, single-stage process where fluid properties are largely kept unchanged or fluids are mixed over several stages using different levels and types of mixing. For example, to purify water, several stages of cleaning may be required. In a first stage, mixing uses large air bubbles to segregate large particles from water, and in a subsequent stage, smaller bubbles are used to activate and aerate water. What is needed is a mixer, a system of mixing, and a method of mixing capable of easy adaptation to mix fluids in a single- or multistage mixing process and to mix fluids at different velocities with bubbles or laminar flow of different sizes and thicknesses.

This disclosure incorporates fully herein by reference International Application No. PCT/US2009/033005, entitled Dynamic Mixing of Fluids, and International Application No. PCT/US2009/033000, entitled Method of Dynamic Mixing Fluids. This first family of mixing technologies and devices teaches how two or more fluids, each traveling in different and often opposite directions in conduits, are mixed using reflector-based technology in a quasi-boiling expansion volume. Mixing results from the merging of two fluids in a phase change at the mixing point.

This disclosure also incorporates fully herein by reference International Application No. PCT/US2008/075378, entitled Foaming of Liquids. This second family of devices teaches how gas bubbles are created and released into an open volume of fluid. Compressed air is split into small flows and is directed sideways into a cavity where liquid is drawn in via forced convection to mix or where radial fins under the flow of incoming bubbles impart a rapid rotational movement and create a vortex in the open volume of fluid.

What is needed is an improved mixing device capable of creating an auto-initiating vortex and self-sustaining vortex without using moving parts in the mixing device. What is also needed is a device capable of creating a multilayered vortex with stratified portions where fluid and layers of bubbles hash for better mixing under conditions of high turbulence.

SUMMARY

The present disclosure generally relates to a fluid mixer, a system for mixing fluids utilizing the fluid mixer, and a method of mixing fluids using the fluid mixer or the system for mixing fluids, and more specifically, to a compact static mixing device with no moving parts capable of mixing any fluid, such as air, nitrogen gas, water, oil, polluted water, and the like. A first pressurized, incoming fluid is accelerated locally by a section reduction, is split into streams, and is then released into a second fluid found in a closed volume or an open volume after a period of stabilization. The directed and controlled first fluid slides along an insert up to directional and angled fins at a vortex creator where suction forces resulting from a self-initiating vortex in an internal cavity draws in at least part of the first fluid to fuel the vortex.

The compactness and simplicity of the fluid mixer with internal vortex can be used alone within a closed volume in a conduit, in a sprayer, or within a fixed geometry to direct the mixing vortex to specific dimensions. The fluid mixer can also be used alone or in a group in an open volume such as a reservoir, tank, pool, or other body of fluid to conduct mixing. The technology alone, as part of a multimixer system, or as a method of mixing using the fluid mixer with internal vortex, is intended to be used in any field where mixing occurs.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION OF THE INVENTION

Figure 1:
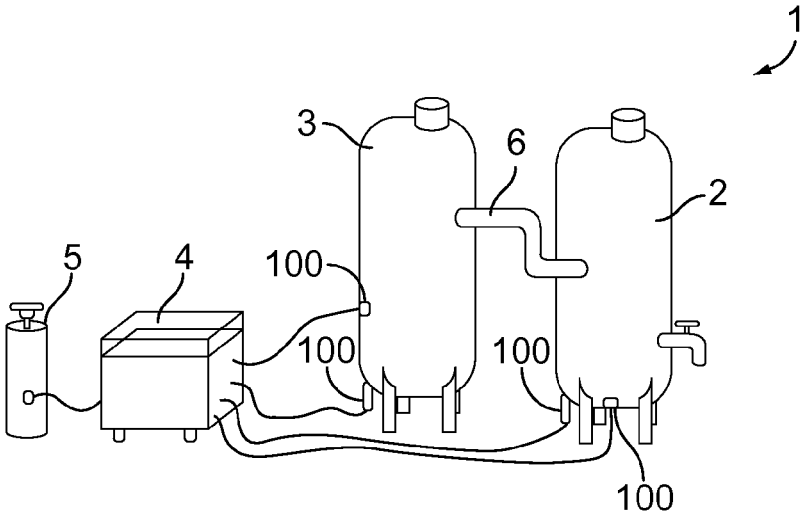
FIG. 1 is an illustration of a system for mixing using a plurality of fluid mixers with an internal vortex according to an embodiment of the present disclosure.

For the purposes of promoting and understanding the principles disclosed herein, reference is now made to the preferred embodiments illustrated in the drawings, and specific language is used to describe the same. It is nevertheless understood that no limitation of the scope of the invention is hereby intended. Such alterations and further modifications in the illustrated devices and such further applications of the principles disclosed and illustrated herein are contemplated as would normally occur to one skilled in the art to which this disclosure relates.

Within the scope of this disclosure, the terms "fluid" and "fluids" shall mean a medium made of particles that easily move and change relative position without a separation of the mass and that easily yield to pressure. Fluids can be compressible or incompressible and shall be inclusive of liquids, gases, small particles of solids such as sand or rocks, ionized gases, or any combination thereof. By way of nonlimiting example, a fluid may be a mixture of two or more liquids, a mixture of a liquid with a dissolved gas, or even a liquid with suspended particles or gas bubbles in the liquid. This definition is meant to focus attention on the fact that the term "fluid" is often perceived as a synonym for "liquid." Within this disclosure, any material that displays fluidic properties falls within the scope of the contemplated embodiment. This definition is not intended to be construed in a limiting way to exclude any material. Further, the terms "vortex" and "vortices" include their ordinary definitions and may also refer to any mass of fluid as defined above having a whirling or circular motion that tends to form a conical or linear structure where at least a portion of the center in the structure is at a depression compared to its rotating edges.

Commonly known types of vortices in fluid include water drains (liquid and gas vortices), tornados (gas and gas vortices), and powerboat propellers (liquid and liquid vortices). In all three of these examples, mixing is incidental to the creation of vortices. Drain vortices allow for the air to exit pipes as liquid is drained down, but the air is not typically mixed in with the drain water. Tornados serve to exchange high-pressure air with low-pressure air between layers of the atmosphere. Powerboat propellers create a vortex as the propeller rotates in the water and displaces water behind the boat to create forward movement. Blenders and mixers, on the other hand, use vortices more specifically to mix solids with fluids, fluids with fluids, and even gases with liquids. In the examples above, tornados and drain vortices are created as a result of conditions in the fluids, but they are not the result of a dynamic moving part that forces fluids into a more stable configuration.

Figure 2:
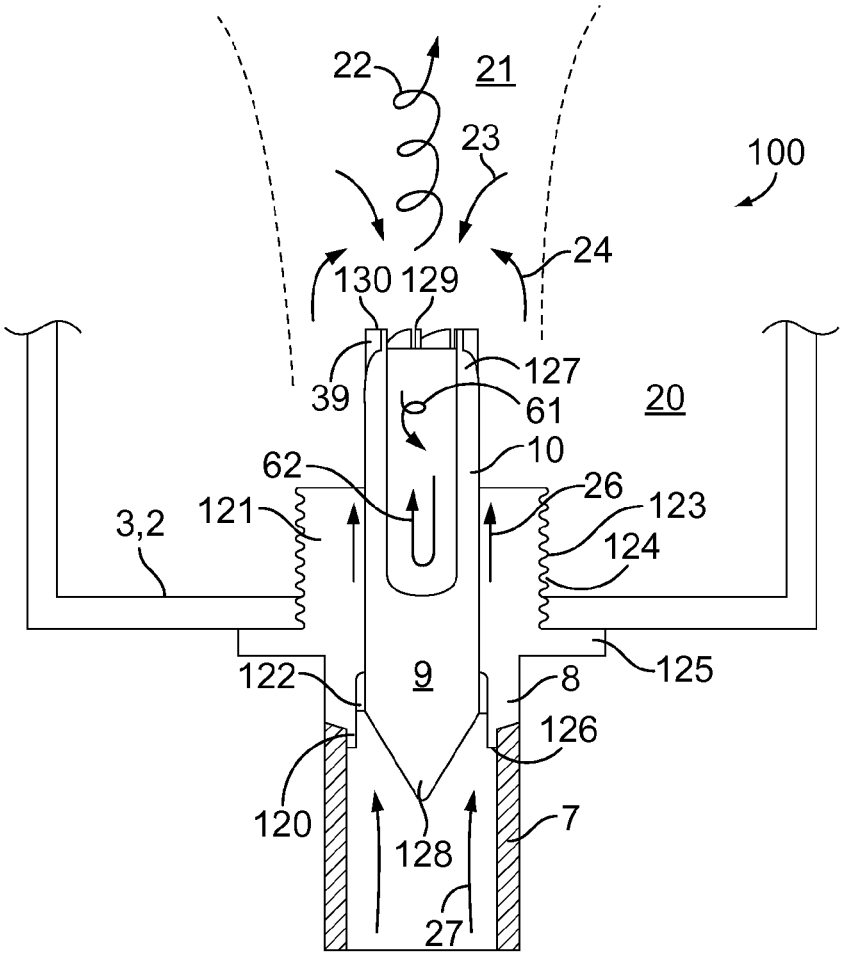
FIG. 2 is a cut-away view of a fluid mixer with internal vortex in an open volume according to an embodiment of the present disclosure.
Figure 3:
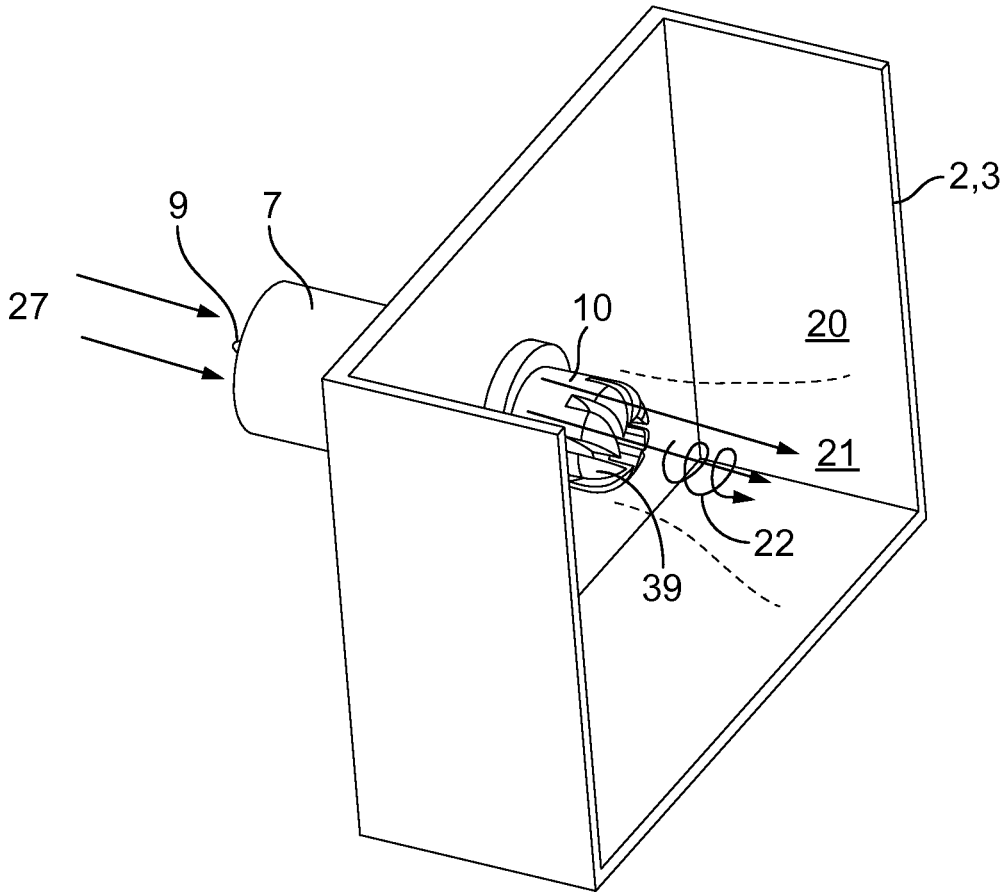
FIG. 3 is a perspective view of the fluid mixer of FIG. 2.
Figure 9:
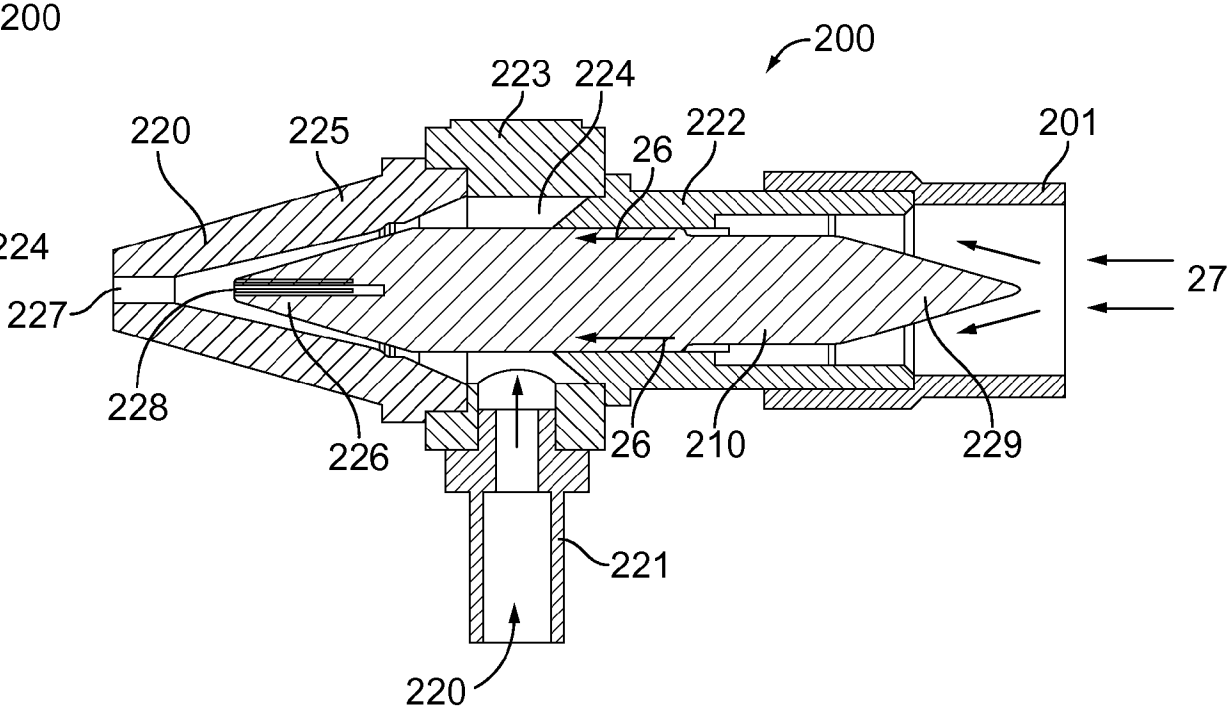
FIG. 9 is a view along cut line 9-9 as shown in FIG. 8.

One of the numerous principles surrounding the present disclosure is the creation of a vortex in a second fluid made while mixing the first and second fluids and resulting from unique conditions created within the mixing device 100 as shown in FIGS. 2 and 9. Flows of the different fluids are placed at unique orientations, thicknesses, and velocities to create in the second fluid a vortex at the vortex creator. By manipulating the different flow conditions, often associated with the characteristics of the fluids, the vortex is altered and calibrated to optimize mixing. For example, in a fluid having a high viscosity, a shorter vortex creator may be required. Calibration of this vortex as part of the mixing device 100 and ultimately the mixing itself does not require undue experimentation by one of ordinary skill in the art. The device 100 is simply placed in any operating condition in contact with any two fluids and the pressure of the first fluid is slowly increased until formation of the vortex is observed. For each contemplated configuration, length and thickness of the different elements may be variable and measured successively. While one embodiment is given, one of ordinary skill in the art understands how the different geometrical parameters, velocities, and angles can changed to create a vortex.

Further, one of ordinary skill in the art of fluid dynamics recognizes the different principles as applied within the mixing device 100, such as the laminar and turbulent flow around the structures based on the speed of the flow, the viscosity and temperature of the fluids, and the thicknesses of limiting layers above the different flow surfaces. Further, the mixing device 100 uses the Bernoulli Principle, which states that for an inviscid flow, an increase in the speed of the fluid occurs simultaneously with a decrease in pressure or a decrease in the fluid's potential energy over a surface. The Bernoulli Principle operates for both compressible and incompressible fluid flows and applies for all fluids contemplated herein. The Bernoulli Principle also stands for a conservation of energy at any position along a streamline where the sum of the kinetic energy and the potential energy of the fluid must remain constant.

FIG. 1 shows a system 1 for mixing using a plurality of fluid mixers 100 and a system for the control of fluid mixers 100. A control mechanism 4 representing any industrial and commercial control system is connected to a plurality of fluid mixers 100 installed on different reservoirs 3, 4 at different locations. For example, some fluid mixers 100 may be placed on the bottom of the reservoirs 3, 4 while others may be placed sideways. Systems 1 with a plurality of tanks may be linked 6 as required in the process. As shown, a plurality of fluid mixers 100 can be placed on a single reservoir 3 or 4. Finally, a first fluid reservoir 5, such as a tank of compressed air, is shown to be part of the system 1. FIG. 1 represents only one of the many varied types of systems 1 contemplated for the mixing of fluids.

FIG. 2 shows a fluid mixer 100 with a holder 8 connected to an inlet pipe 7. The holder includes a fluid inlet 120 and a fluid outlet 121 defining a holding cavity 122 between the fluid inlet 120 and the fluid outlet 121 for the transfer of a first fluid 27 from the fluid inlet 120 to the fluid outlet 121. As shown in FIG. 2, the external surface of the holder 123 may include a fixation means 124 such as threads or stops with a leak-proof edge 125 to place the holder 8 in communication with the second fluid 20 in a reservoir 2, 3. While one type of fixation means is shown, any type of permanent and impermanent fixing means, including but not limited to a holder 8 capable of being disassembled to change and replace the insert 9 into the holder 8, is contemplated. In one embodiment, the insert 9 is held in place in the holder 8 by the air pressure 27 from the incoming first fluid. As shown in FIG. 2, the inlet pipe 7 is a flexible tube slid over a notch made at the fluid inlet 120. Again, while one method of attachment is shown, any means of attachment or connection is contemplated.

Further, the holder 8 includes an internal surface 126 in communication with the first fluid 27. The holder 8, much like the insert 9, is made in a preferred embodiment of stainless steel or other metal having a good rigidity and that is not corroded by either the first or second fluids 27, 20. Other materials, such as an inert ceramic, a hardened plastic, a thermoset resin compound over carbon fibers, can also be used. One of ordinary skill in the art recognizes that while other materials are contemplated, flow parameters over these materials, such as surface friction, must be used to calibrate the device properly.

The fluid mixer 100 further includes an insert 9 with an external surface 127 slid at least partly into the holding cavity 122 as shown and in contact with a second fluid 20, the insert 9 having a first end 128 and a second end 129 where the second end includes a vortex creator 130. In one embodiment, the insert 9 also includes an expansion area 26 between the first end 128 and the second end 129. The expansion area 26 as shown may be at the interface between the internal surface 126 of the holding cavity 122 and the external surface 127 of the insert 9. The passage area shown as 26 may also be calibrated to create a layer of fluid as illustrated by the arrows where the first fluid 27, as it exits into the second fluid 20, is pushed along the surface of the insert 9 and has a fixed thickness at the expansion area for the creation of small volumes of the first fluid 27 such as bubbles having a radius in proportion with the fixed thickness. In one embodiment, the thickness is calibrated between approximately 1 micron and 100 microns.

Figure 4:
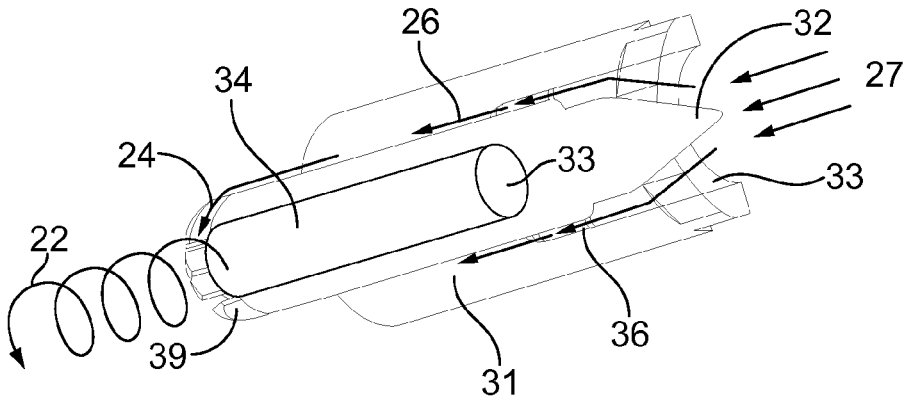
FIG. 4 is a partial view of a perspective illustration of the fluid mixer of FIG. 2 without a possible fixation to an open or closed volume of a second fluid illustrating the displacement of the first fluid and the internal vortex according to an embodiment of the present disclosure.

Further, the holding cavity 122 may include a means for splitting the first fluid 27 into a plurality of streams as shown by the arrows in FIG. 4 before entry of the first fluid 27 into the expansion area 26. Many different means for splitting are contemplated. In one embodiment as shown in FIGS. 2-7, the first fluid 27 is split at the first end 128 into a plurality of openings 64 in communication with the expansion area 26. As shown in greater detail in FIG. 7, the plurality of openings is created by a series of slotted elements 65 at the circumference of the insert 9. The splitting may be initiated at a cone 32, also located at the first end 128, to reduce the passage area and thus increase the speed of the first fluid 27. The first fluid then travels in the openings 64. A small notch 63 may also be made on in the body 31 of the insert 9. While one configuration is shown where the slotted elements 65 are located on the insert 9, other configurations are contemplated, such as the design of the slotted elements as part of the holder 8, the use of small conduits, or holes drilled into the insert 9.

Figure 6:
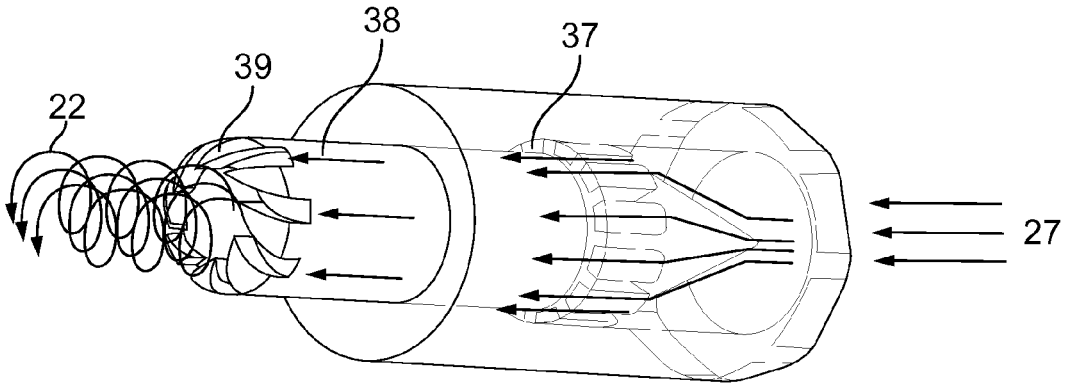
FIG. 6 is a perspective view of FIG. 5 as viewed from a different angle.
Figure 7:
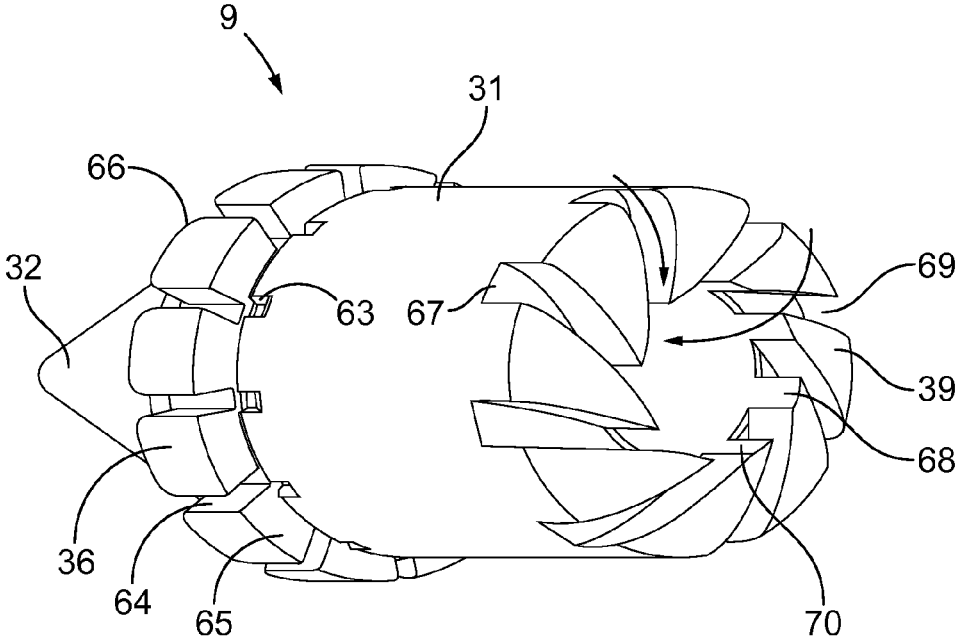
FIG. 7 is a perspective view of the insert as part of the fluid mixer of FIG. 2 according to an embodiment of the present disclosure.
Figure 8:
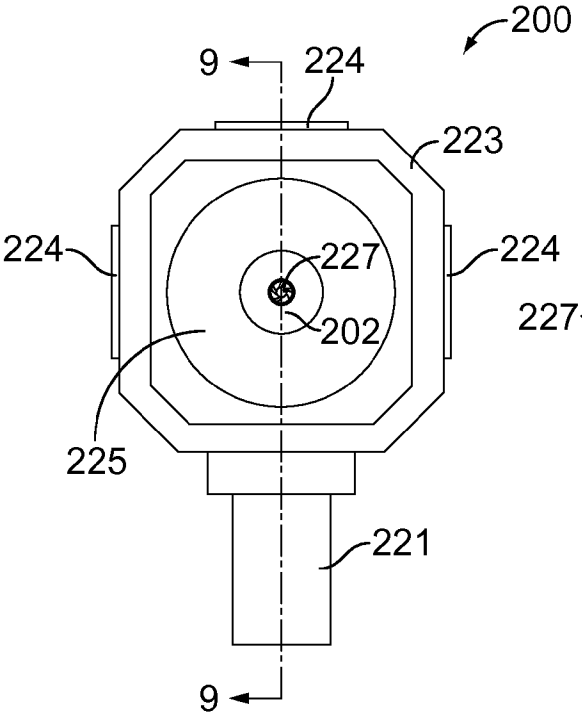
FIG. 8 is a front view of a fluid mixer where the vortex creator is disposed within a holding cavity according to another embodiment of the present disclosure.

The vortex creator 130 on the insert 9 includes an internal cavity 62 at the second end 129, the internal cavity 62 being in communication with the second fluid 20, and includes at least an angled fin 39 for the passage of the first fluid 27 from the external surface of the insert 127 to the internal cavity 62. FIG. 7 shows with greater detail the finned area of the insert 9. A plurality of fins 39 are created on the external periphery of the second end 129. As shown in FIG. 8, radial openings 64 are placed at 45° angles around the second end 129. The configuration of the fins has a thickness 70 and a variable opening 69 from the external to the internal portion of the insert 9. As the vortex is created inside insert 9 in the internal cavity 62 as shown in FIG. 6, the pressure in the cavity drops and creates an aspiration of the first fluid located on the immediate surface of the insert 9. While flat and angled fins are shown to impart upon the vortex a rotational energy as the first fluid 27 is drawn in, other passageway configurations are contemplated, such as passageways with small, angled holes or slits made in the middle portion of the insert, etc. FIGS. 9-12 described later show a different configuration of fins 39 as part of the insert 9.

In a preferred embodiment, the first fluid 27 is air, pressurized air, nitrogen gas, pressurized inert gas, or oxygen gas. As the first fluid 27 travels along the insert 9, the first fluid 27 may undergo an expansion as it enters the second fluid 20, which may be at a lower absolute or relative pressure. For example, if pressurized air at 15 bars enters the fluid mixer 100 and is ultimately released into a liquid such as water at an absolute pressure of 2 bar (assuming the reservoir has a 10 meter water column), the air expands by a factor of 13.

Two possible embodiments are shown in FIGS. 2-7 and 8-12, respectively. The first embodiment is a configuration where second fluid 20 in fluidic contact with the vortex creator 130 is a large open volume such as a tank, a reservoir 2, 3, or other body of water. A vortex created is confined in space by the dynamic movement of water around the vortex. In a second embodiment, a gun 200 is used where the second fluid 27 is in fluidic contact with the vortex creator in a confined portion of a holding cavity. The holder 222 as shown in FIG. 9 includes an opening 221 for the entry of the second fluid 220 to mix with the first fluid 27.

Figure 10:
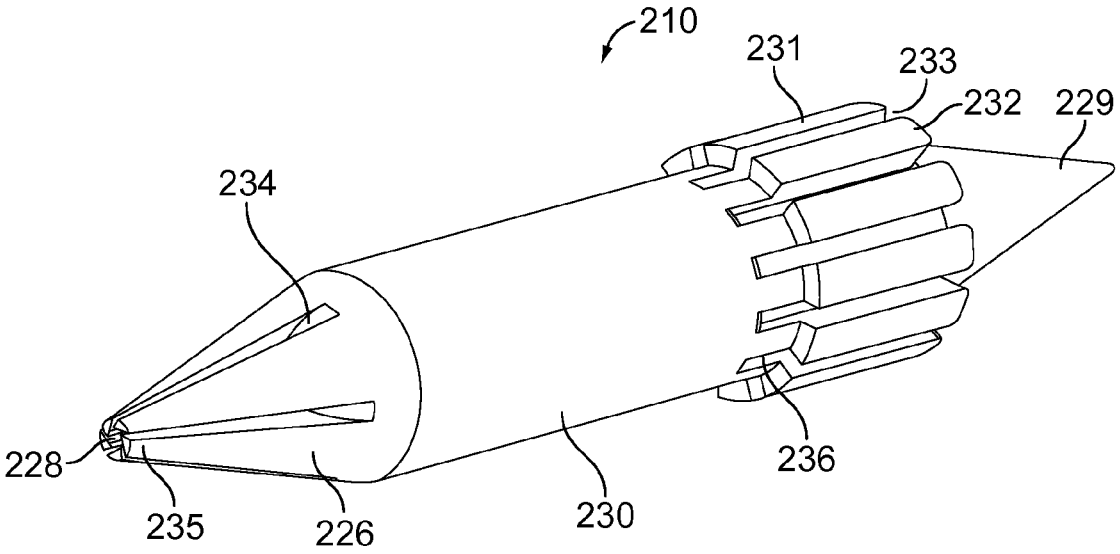
FIG. 10 is a perspective view of the insert of the fluid mixer of FIG. 8.
Figure 11:
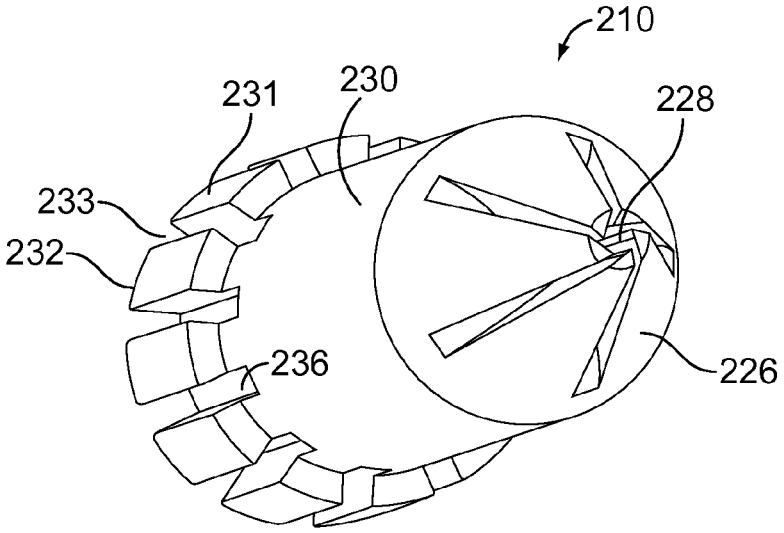
FIG. 11 is a different perspective view of the insert of the fluid mixer of FIG. 8.
Figure 12:
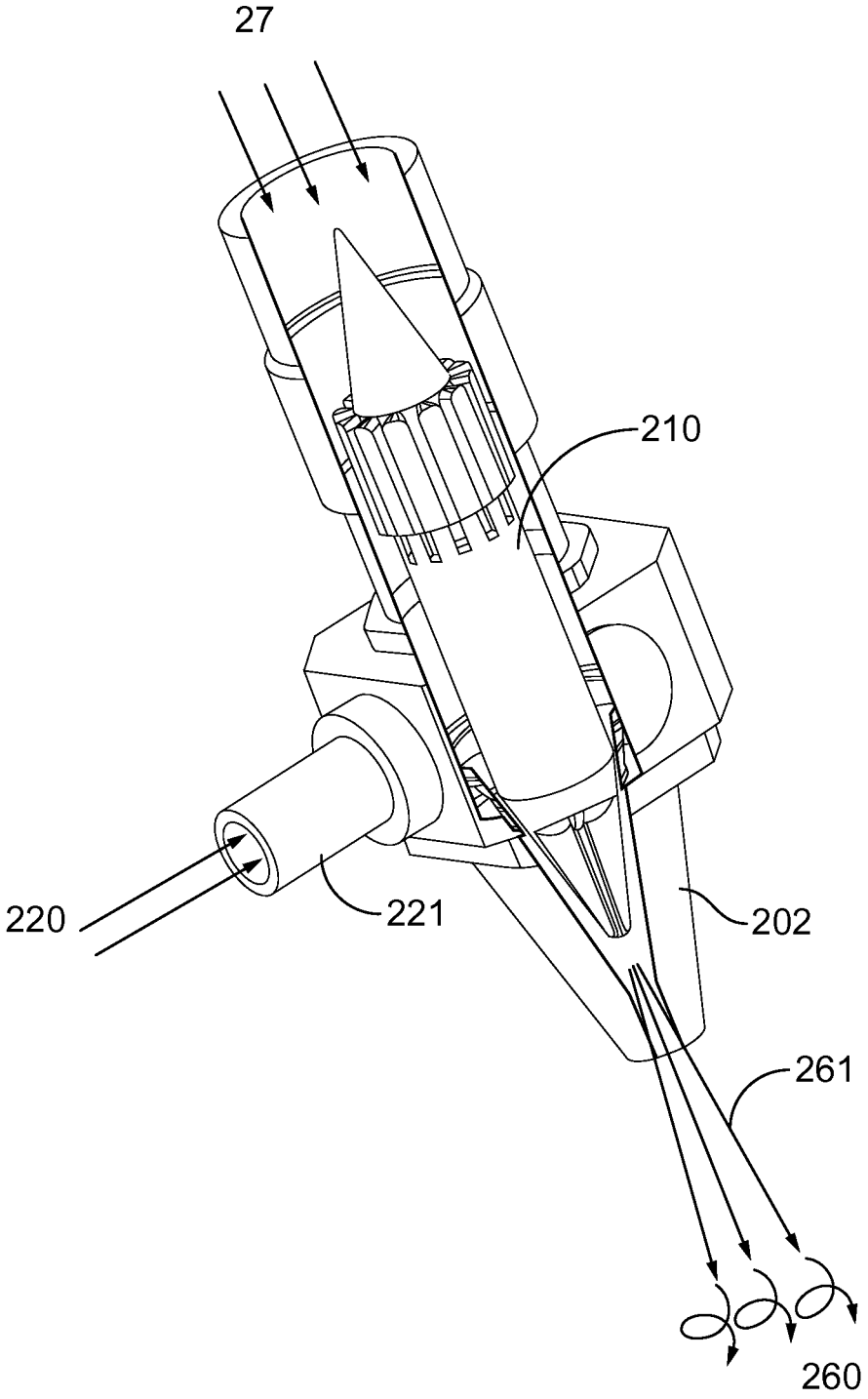
FIG. 12 is a partially shadowed perspective illustration of the fluid mixer of FIG. 8 with functional representation of the first and second fluids according to an embodiment of the present disclosure.

FIG. 9 shows another possible embodiment of the technology described above where a holder 222 includes a first end 229 and a second end 202 where the first end 229 is connected to a connector 201 for the arrival of the first fluid 27. The first fluid is split into streams 26 and then mixed with the second fluid at 224. While one input of second fluid is shown, other apertures are contemplated as 224 by altering piece 223. The insert 210 as shown in FIGS. 10 and 11 also includes a splitting means made of circumferential segments 232 with openings 233 and associated notches 236. The first fluid 27 may also expand along the body 230 of the insert 210 before reaching the second fluid 224 and entering the internal cavity 228 via the five fins 226 as shown. A vortex created in the internal cavity 228 is released through the opening 227.

As shown, the insert 9 or 210, depending on the embodiment, is shown as a piece slid into the holders 8 or 222. An equivalent construction where the insert 9 or 210 is fixed to the holder 8 or 222 or is built from one or a plurality of pieces having the same functionality is also contemplated. In several embodiments, the thickness of the first fluid released into the second fluid varies, and mechanical variations of the different internal and external dimensions of the holder 8 or 222 and/or inserts 9 or 210 are contemplated. Users of a plurality of fluid mixers 100 may remove the connector 7, pull out the insert 9, and replace the insert 9 with one having differently sized openings 64. The fluid mixer 100 is designed to be modular for easy access to the different elements of the device along with the capacity to replace and change the different portions of the device creating the vortex.

As the first fluid 27 expands from a pressurized state to reach the depressurized state of the second fluid 20, the fluid 27 may cool via thermodynamic expansion and locally cool a portion of the fluid mixer 100, such as at the interface between the holder 8 and the insert 9. This expansion may be used to cool the first fluid 27 as it travels past a portion of the structure cooled. A cooled first fluid 27 then reaches the vortex creator 130 and mixes with the second fluid 20, thereby cooling the second fluid.

Air may be used first fluid 27 to aerate the second fluid by mixing air bubbles or other fixed volumes into the second fluid 20. If using nitrogen gas as the first fluid 27, the fluid mixer 100 may enrich the second fluid 20 with nitrogen for agricultural applications. In another embodiment, the mixer 100 is used by itself or as part of a system for irrigation of soil where the second fluid 20 is water and the first fluid 27 is a gas mixed in at the vortex creator 130 to alter the properties of water to slow the rate of seepage of water in soil. In another embodiment, the first fluid 27 further includes a fertilizer.

In other numerous contemplated embodiments, the device 100 for mixing fluid is used as a foam generator and the vortex created by the vortex creator mixes a gas in a second fluid 20 to create a foam. The device for mixing fluid 100 can also be used as a parts washer where the vortex created by the vortex creator is directed onto a part resting in a parts washer immersed in the second fluid 20. Also, the device 100 for mixing fluids can also be used as an emulsifier where the vortex created by the vortex creator uses a first fluid 27 to emulsify the second fluid 20.

The use of a single fluid mixer 100 as shown in FIG. 2 is described above. The use of a system for mixing using a plurality of fluid mixers 1 as shown figuratively in FIG. 1 is also contemplated. The system 1 may include at least two fluid mixers 100 where each fluid mixer 100 has a holder 8 with a fluid inlet 120 and a fluid outlet 121 and an insert 9. The fluid inlets 120 of each fluid mixers 100 are either in contact with a different first fluid 27 or in contact with the same first fluid 27. If the system includes a single reservoir 2, 3, each insert 9 is connected to a single second fluid 27, but if the system 1 includes several reservoirs 2, 3, each mixer 100 is in contact with a different second fluid 27.

In a fluid mixer system 1, different requirements may warrant different fluid mixers 100 with different mixing properties. In one embodiment, at least two of the fixed thicknesses of different fluid mixers 100 are different. In another configuration, at least one of the fluid mixers is oriented vertically, and the vortex creator is aligned to create a vortex from the bottom of a surface of the second fluid 20 to the natural surface of the second fluid 20.

Figure 5:
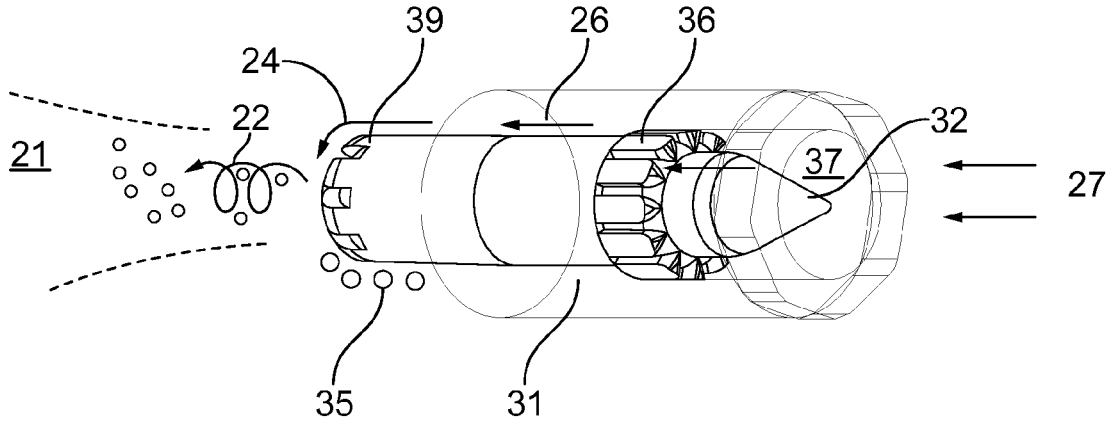
FIG. 5 is a partially shadowed perspective view of the fluid mixer of FIG. 2 where the holder is shadowed.

In the case of the creation of bubbles 35 of the first liquid 27, FIG. 5 shows how these bubbles may partly enter the internal cavity around the edge 24 before they are released outwards 22 along a vortex-like path. Some of the first fluid 27 may also continue outwards and create an external layer of turbulent first fluid 27 surrounding an internal inward flow of second fluid 20.

In one embodiment, a method of operation of a mixing system is contemplated, the method comprising the steps attaching at least a fluid mixer 100 to a reservoir 2, 3, placing a volume of the second fluid 20 in the reservoir 2, 3 so at least a natural surface of the second fluid covers the internal cavity 62 of the mixer 100, and connecting a first fluid 27 at the fluid inlet 120 to at least one fluid mixer 8 and allowing the first fluid 27 to travel in the fluid mixer 100 to form a vortex for mixing the first fluid with the second fluid 20 in the reservoir 2, 3. The method may further include the step of attaching a second fluid mixer 100 to the reservoir 2, 3 and connecting the first fluid 27 at the fluid inlet 120 of the second fluid mixer 100 to allow the first fluid 7 to travel in the fluid mixer 100 and form a second vortex for mixing the first fluid 27 with the second fluid in the reservoir 2, 3.

In another method for controlling a system for mixing fluids, the method includes the step of controlling a flow of the first fluid 27 in the fluid mixer 100 using a central control system 4 from a remote location. The control of the flow of the first fluid 27 may be accomplished using an input from a sensor (not shown) for measuring a characteristic of the second fluid 20. In a multimixer system, the method further include the step of attaching a second fluid mixer 100 to the reservoir 2, 3, connecting the first fluid 27 at the fluid inlet 120 of the second fluid mixer 100, and controlling the flow of the first fluid 27 at the fluid inlet 120 of the second fluid mixer 100 by the central control system 4.

It is understood that the preceding detailed description of some examples and embodiments of the present invention may allow numerous changes to the disclosed embodiments in accordance with the disclosure made herein without departing from the spirit or scope of the invention. The preceding description, therefore, is not meant to limit the scope of the invention but to provide sufficient disclosure to one of ordinary skill in the art to practice the invention without undue burden.

What is claimed is:

1. A fluid mixer, comprising:

a holder with a fluid inlet and a fluid outlet defining a holding cavity between the fluid inlet and the fluid outlet for the transfer of a first fluid from the fluid inlet to the fluid outlet, the holder further including an internal surface in communication with the first fluid; and an insert with an external surface slid at least partly into the holding cavity and in contact with a second fluid, the insert having a first end and a second end with a vortex creator, and an expansion area between the first end and the second end, wherein the holding cavity includes a means for splitting the first fluid into a plurality of streams before entry of the first fluid into the expansion area, and wherein the vortex creator includes an internal cavity at the second end, the internal cavity in communication with the second fluid and including at least an angled fin for the passage of the first fluid from the external surface to the internal cavity, and wherein the vortex creator includes a plurality of angled fins defining a plurality of passageways at the second end.

2. A fluid mixer, comprising:

a holder with a fluid inlet and a fluid outlet defining a holding cavity between the fluid inlet and the fluid outlet for the transfer of a first fluid from the fluid inlet to the fluid outlet, the holder further including an internal surface in communication with the first fluid; and an insert with an external surface slid at least partly into the holding cavity and in contact with a second fluid, the insert having a first end and a second end with a vortex creator, and an expansion area between the first end and the second end, wherein the holding cavity includes a means for splitting the first fluid into a plurality of streams before entry of the first fluid into the expansion area, and wherein the vortex creator includes an internal cavity at the second end, the internal cavity in communication with the second fluid and including at least an angled fin for the passage of the first fluid from the external surface to the internal cavity, and wherein the first fluid has a fixed thickness at the expansion area defined by the distance between the external surface and the internal surface for creation of small volumes of the first fluid with a radius of the fixed thickness.

3. The fluid mixer of claim 2, wherein the fixed thickness is calibrated between approximately 1 micron and 100 micron.

4. A device for mixing fluids using a vortex creator, the device comprising:

a holder with a fluid inlet and a fluid outlet where the fluid inlet is in contact with a first fluid and the fluid outlet is in contact with a second fluid, the holder defining a holding cavity between the fluid inlet and the fluid outlet for the passage of the first fluid; and an insert into the holding cavity for guiding the first fluid from the fluid inlet through the fluid outlet for mixing the first fluid with the second fluid, the insert having at a first end a means for splitting the first fluid, at a second end in opposition to the first end a vortex creator with an internal cavity and at least an angled fin for the delivery of the first fluid from the second end through the second fluid to the angled fin, wherein the internal cavity of the vortex creator initiates and maintains a depression vortex within the internal cavity and pushes out into the second fluid a mixture of the first fluid and second fluid.

5. The device of claim 4, wherein the vortex created by the vortex creator is used to cool the second fluid by cooling expansion of the first fluid into the second fluid.

6. The device of claim 4, wherein the first fluid is air and the vortex created by the vortex creator is used to aerate the second fluid by mixing air bubbles into the second fluid.

7. The device of claim 4, wherein the first fluid is nitrogen gas and the vortex created by the vortex creator is used to enrich the second fluid with nitrogen for agricultural applications.

8. The device of claim 4, wherein the device is used for irrigation of soil and wherein the second fluid is water and the first fluid is a gas mixed in at the vortex creator to alter the properties of water to slow the rate of seepage of water into soil.

9. The device of claim 8, wherein the first fluid includes a fertilizer.

* * * * *